US012601078B2

(12) United States Patent
Harris, II et al.

(10) Patent No.: US 12,601,078 B2
(45) Date of Patent: Apr. 14, 2026

(54) INTEGRATED THERMIONIC DIODE AND MOLTEN OXIDE ELECTROLYSIS CELL

(71) Applicant: Blue Origin Manufacturing, LLC, Hunstville, AL (US)

(72) Inventors: Vernon G. Harris, II, Los Angeles, CA (US); Alex M. Román, Santa Monica, CA (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 0 days.

(21) Appl. No.: 18/761,120

(22) Filed: Jul. 1, 2024

(65) Prior Publication Data

US 2026/0002278 A1 Jan. 1, 2026

(51) Int. Cl.

| | |
|---|---|
| ***C25C 7/06*** | (2006.01) |
| ***C25C 3/34*** | (2006.01) |
| ***C25C 7/00*** | (2006.01) |
| ***C25C 7/02*** | (2006.01) |
| ***C25D 3/66*** | (2006.01) |

(52) U.S. Cl.
CPC ..... *C25C 7/06* (2013.01); *C25C 3/34* (2013.01); *C25C 7/005* (2013.01); *C25C 7/025* (2013.01); *C25D 3/66* (2013.01)

(58) Field of Classification Search
None
See application file for complete search history.

(56) References Cited

U.S. PATENT DOCUMENTS

| | | | | |
|---|---|---|---|---|
| 11,417,506 | B1 * | 8/2022 | Birmingham | H01J 9/042 |
| 2023/0078959 | A1 * | 3/2023 | Geifman | C25B 1/02 205/636 |
| 2025/0250690 | A1 * | 8/2025 | Lange | C25B 9/09 |

FOREIGN PATENT DOCUMENTS

| | | | | |
|---|---|---|---|---|
| JP | S62278103 A | * 12/1987 | ..... | C01B 7/192 |

OTHER PUBLICATIONS

English abstract of Shigeki, JP S62278103 A (Year: 1986).*

* cited by examiner

*Primary Examiner* — James Lin
*Assistant Examiner* — Wojciech Haske
(74) *Attorney, Agent, or Firm* — Summit Patents PC

(57) ABSTRACT

A method and system for producing and collecting oxygen gas using molten oxide electrolysis is presented. The system includes a refractory vessel to hold molten oxide material, an anode, a cathode, and a thermionic diode at a top portion of the refractory vessel. The anode for the electrolysis cell (e.g., the anode and cathode that are positioned in the vessel to perform electrolysis) has a dual function by also acting as the cathode of the thermionic diode. Among other things, the presence of the thermionic diode may limit the direction of electrical current flow so that current only flows from the anode to the cathode of the electrolysis cell. This directional limitation provides an advantage in that an AC power source of the MOE system need not be rectified or converted to DC before powering the MOE system.

20 Claims, 4 Drawing Sheets

INTEGRATED THERMIONIC DIODE AND MOLTEN OXIDE ELECTROLYSIS CELL

BACKGROUND

Future exploitation of lunar resources may involve extraction of materials from lunar regolith. Though the exact composition of lunar regolith is not well known for many of the diverse regions of the Moon, the lunar surface regolith appears to be consistent in that it comprises substantial percentages of oxides. In particular, lunar regolith contains minerals primarily comprising elements such as silicon, titanium, aluminum, magnesium, iron, and calcium, which are typically measured and expressed in their oxide form.

Molten oxide electrolysis (MOE) is being pursued as an alternative for existing metal production technologies as well as for in situ oxygen and metal production on planetary bodies such as the Moon and Mars. MOE is a process that may be used to reduce molten oxides to their metal form using an electric current. For example, MOE may be used as an electrometallurgical technique to produce iron metal in a liquid state from oxide feedstock.

Exploiting lunar resources, such as with MOE processes, will likely require a power system that involves electricity that may be generated relatively far from its point of utilization. Generally, for long distances, electrical power is transmitted as AC (alternating current) at high voltages. Accordingly, the electrical power may need to be lowered in voltage and converted to DC (direct current) so it can be utilized by loads at its destination. Such conversion adds complexity to the power system. Thus, loads that do not require conversion from AC to DC may be preferred.

BRIEF DESCRIPTION OF THE DRAWINGS

The disclosure will be understood more fully from the detailed description given below and from the accompanying figures of embodiments of the disclosure. The figures are used to provide knowledge and understanding of embodiments of the disclosure and do not limit the scope of the disclosure to these specific embodiments. Furthermore, the figures are not necessarily drawn to scale.

DETAILED DESCRIPTION

Figure 1:
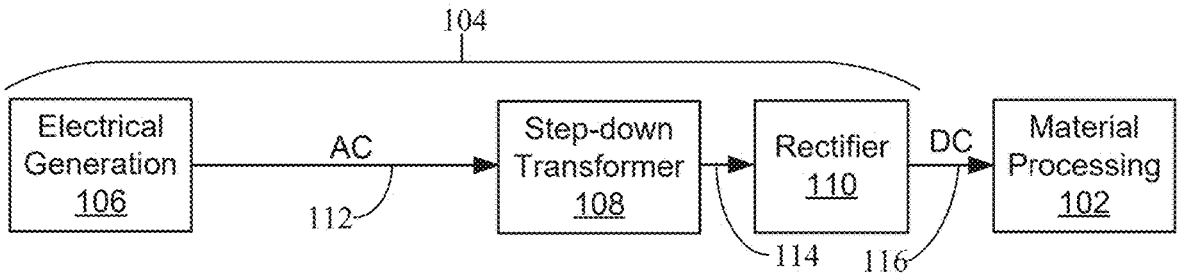
FIG. 1 is a block diagram of a material processing system powered from an electrical distribution network, according to some embodiments.

This disclosure describes, among other things, a system and a method for performing molten oxide electrolysis (MOE). In some processes of MOE, molten metal oxides may be used as an electrolyte. The metal oxides may be dissolved in a molten state and electrolysis may occur to extract metal(s) directly from the oxide(s). Oxygen gas may also be produced. For example, the method may involve producing oxygen gas from molten oxide material sourced from lunar regolith during electrolysis, though the method may be applied on Earth or Mars. The method may be performed using a system that includes a refractory vessel to hold the molten oxide material, an anode and cathode, and a thermionic diode at a top portion of the refractory vessel (hereinafter "vessel"). In particular, the anode for the electrolysis cell (e.g., the anode and cathode that are positioned in the vessel to perform electrolysis) has a dual function by also acting as the cathode of the thermionic diode. Among other things, the presence of the thermionic diode may limit the direction of electrical current flow so that current only flows from the anode to the cathode of the electrolysis cell. This directional limitation provides an advantage in that an AC power source of the MOE system need not be rectified or converted to DC before powering the MOE system.

The system and method for performing MOE, such as for producing oxygen gas, may be particularly useful on the Moon, which has on its surface lunar regolith containing large amounts of oxides and other compounds that may be decomposed by electrolyzing molten lunar regolith. In particular, iron and oxygen are primary constituents of lunar regolith and a molten iron cathode electrolytic cell, as described below, may be used to separate and remove iron and oxygen from the lunar regolith.

In embodiments, a method may involve a vessel used for an MOE process. The vessel, during the process, includes a molten mixture of metal oxides and a heavier liquid metal cathode that contains a metal or metalloid that may be subsequently extracted from the vessel. In some implementations described herein, the liquid metal cathode is iron. Due to its relative density, the heavier liquid metal cathode (e.g., iron) may sink to the bottom of the vessel, which includes a cathodic electrode located at or near the bottom of the vessel. The vessel also includes an anode. The cathodic electrode and the anode of the electrolysis cell may be part of an electrical circuit that includes a voltage or current source. Accordingly, a current may flow between the anode and cathodic electrode, creating a voltage difference across molten oxide material that is between the anode and cathodic electrode. Per its location in the vessel, the cathodic electrode is configured to be in electrical contact with contents (e.g., the liquid metal cathode, such as iron) at or near the bottom of the vessel. The electrical current between the anode and cathodic electrode may allow for a process of electrolysis of the molten oxide material. The electrolysis of the molten oxide material may lead to either the formation of cathode material or the creation of metal that can dissolve into an already existing liquid cathode, which is in electrical contact with the cathodic electrode.

In some implementations, oxide material used in the method may be derived from lunar regolith. For example, iron oxide may be in lunar regolith, or in minerals found on off-Earth locations and/or objects in the Solar System, such as asteroids, moons, minor-planets, and planets, among other objects. Of course, iron oxide is also present on Earth, and methods described herein may be performed on Earth, the moon, or other bodies listed above, and claimed subject matter is not limited in this respect.

As mentioned above, the electrolysis cell may be part of an electrical circuit that includes a voltage or current source. In some implementations, a power source for the electrolysis cell part of the circuit may be a DC power source. This is preferred over an AC power source because electrolysis generally works more effectively with DC power input. For example, DC provides a steady flow of electrons in one direction and ions in the electrolyte are attracted to the electrode of opposite charge (anode or cathode) allowing for separation of the components of the electrolyte. In contrast, with AC power input, during each half-cycle, ions are pulled in opposite directions, leading to inefficient separation. The ions oscillate back and forth, preventing effective accumulation at the electrodes.

In some embodiments described herein, an electrolysis cell of an MOE system may be powered by an AC source. In these embodiments the MOE system includes a thermionic diode, as mentioned above, that effectively "converts" the AC power input to DC, because power can only flow in one direction through the thermionic diode.

A thermionic diode is a device that utilizes the flow of electrons emitted from a heated electrode. The thermionic diode generally includes two electrodes (anode and cathode) separated by a vacuum or a low-pressure gas. When one electrode (the cathode) is heated, electrons are emitted from its surface and flow toward the cooler electrode (the anode).

In some embodiments, an MOE system, which may itself be an electrolysis cell diode or include one or more electrolysis cell diodes, may include a vessel configured to contain a melted oxide material that includes a liquid cathode at a bottom portion of the vessel and a cell anode in a top portion of the vessel. The liquid cathode, the cell anode, and the melted oxide material are herein referred to as an MOE cell. The cell anode may be positioned to be partially submerged in the melted oxide material and in electrical communication with the liquid cathode via the melted oxide material during an MOE process. The system may further include a thermionic diode in the top portion of the vessel. The thermionic diode comprises a diode anode and a diode cathode. Interestingly, the top portion of the cell anode may perform a secondary role in an MOE process by also functioning as the diode cathode. During the MOE process, the diode cathode (e.g., the cell anode) may be heated by the partially surrounding melted oxide material so as to thermionically emit electrons. In some implementations, the electrons may flow unobstructed between the diode cathode and diode anode in the vacuum of the lunar surface.

During the MOE process, oxygen ions (e.g., $O^{2-}$) flow toward the cell anode and are oxidized to produce oxygen gas ($O_2$) bubbles. In some implementations, the cell anode (e.g., the diode cathode) may be angled substantially away from horizontal so that the oxygen gas flows mostly toward one side of the vessel. Such a flow may reduce the amount of oxygen gas that drifts between the diode cathode (e.g., the cell anode) and the diode anode.

In some embodiments, an MOE system may include a stepdown transformer and an electrolysis cell diode connected to an output of the stepdown transformer. An electrolysis cell diode is herein considered to be an MOE cell that is integrated with (e.g., includes) a thermionic diode. For example, the electrolysis cell diode may comprise a vessel configured to contain a melted oxide material that includes a liquid cathode at a bottom portion of the vessel, a cell anode in a top portion of the vessel, and a thermionic diode in the top portion of the vessel. The cell anode may be configured to be partially submerged in the melted oxide material and in electrical communication with the liquid cathode via the melted oxide material.

In some implementations, the MOE system may further include a second electrolysis cell diode. As explained below, if the stepdown transformer is a center-tapped transformer, then the first electrolysis cell diode may be connected to an upper half of the center-tapped transformer to produce a first half-wave rectified voltage, and the second electrolysis cell diode may be connected to a lower half of the center-tapped transformer to produce a second half-wave rectified voltage. The first half-wave rectified voltage may then be 180 degrees out of phase from the second half-wave rectified voltage.

In some implementations, the system may further include additional electrolysis cell diodes that are electrically connected to the first electrolysis cell diode and to one another. In particular, the additional electrolysis cell diodes may be electrically connected to the first electrolysis cell diode and to one another in a bridge rectifier configuration. Moreover, in some implementations, the system may further include an electrolysis cell diode load connected to output terminals of the bridge rectifier configuration so that the electrolysis cell diode load is configured to receive a full-wave rectified voltage, as described below.

In some embodiments, a method of operating MOE systems described above may include receiving high-voltage alternating current at an input of a stepdown transformer, producing low-voltage alternating current at an output of the stepdown transformer, providing the low-voltage alternating current to an electrolysis cell diode, and rectifying the low-voltage alternating current by passing the low-voltage alternating current through the electrolysis cell diode, which includes a thermionic diode.

In some implementations, the method may further include adding one or more additional electrolysis cell diodes and interconnecting the one or more additional electrolysis cell diodes to produce a half-wave or full-wave rectified voltage at outputs of the one or more additional electrolysis cell diodes.

FIG. 1 is a block diagram of a material processing system 102 powered from an electrical distribution network 104, according to some embodiments. For example, material processing system 102 may be an MOE system that is powered by DC voltage. Network 104 may include an electrical generation system 106, a step-down transformer 108, and a rectifier 110 that converts AC to DC. Electrical generation system 106 may include any of a number of ways to generate electricity, such as solar panels or nuclear reactors. Regardless of the method of generation, the electricity may be transmitted fairly long distances preferably at a relatively high voltage to reduce ohmic losses. AC voltages may be more efficiently converted from low to high and from high to low voltages in comparison to such conversion of DC voltages. Accordingly, for long distance transmission (or for any distance), electrical conductor(s) 112 may carry relatively high voltage AC from electrical generation system 106 (which may include a voltage step-up transformer (not illustrated)) to step-down transformer 108. Herein, reference to "AC" is not limited to any particular frequency or to a sinusoid.

Step-down transformer 108 may reduce the voltage of conductor(s) 112 to a lower voltage that may be utilized (or easier to work with) by material processing 102. For a nonlimiting example, conductor(s) 112 may be at an RMS (root-mean-square) voltage of about 20,000 volts and step-down transformer 108 may lower this voltage to 20 volts on conductor(s) 114. Rectifier 110 may subsequently rectify this voltage to a DC voltage. Herein, reference to "DC" is not limited to a constant voltage or current but refers to an electrical current that flows in only a single direction. Thus, electricity (e.g., power) on conductor(s) 116 is provided to material processing system 102 as low voltage DC.

Figure 2:
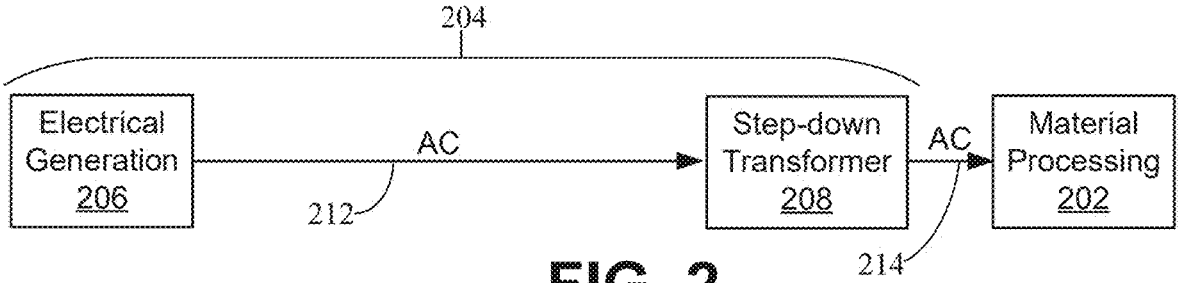
FIG. 2 is a block diagram of a material processing system powered from a non-rectified electrical supply, according to some embodiments.

FIG. 2 is a block diagram of a material processing system 202 powered from an electrical distribution network 204 that is not rectified at the input of system 202, according to some embodiments. For example, material processing system 202 may be an MOE system that is powered by AC voltage. Network 204 may include an electrical generation system 206 and a step-down transformer 208. Electrical generation system 206 may include any of a number of ways to generate electricity, such as solar panels or nuclear reactors. Regardless of the method of generation, as explained above, the electricity may be transmitted fairly long distances preferably at a relatively high voltage AC to reduce ohmic losses. Accordingly, for long distance transmission (or for any distance), electrical conductor(s) 212 may carry relatively high voltage AC from electrical generation system 206 (which may include a voltage step-up transformer (not illustrated)) to step-down transformer 208.

Step-down transformer 208 may reduce the voltage of conductor(s) 212 to a lower voltage that may be utilized (or easier to work with) by material processing 202. Step-down transformer 208 may transform the relatively high voltage AC on conductor(s) 212 to a relatively low voltage AC on conductor(s) 214. In this part of the circuit of network 204, there is no rectifier to convert the AC on conductor(s) 214 to DC at the input of material processing system 202. Thus, electricity (e.g., power) on conductor(s) 214 is provided to material processing system 202 as low voltage AC.

Figure 3:
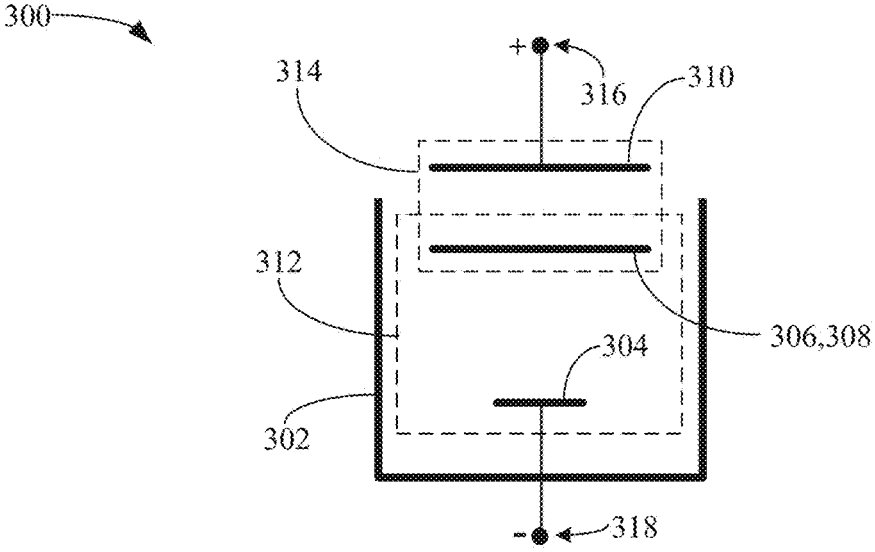
FIG. 3 is a schematic cross-section of a vessel and electrodes of a molten oxide electrolysis system that includes a thermionic diode, according to some embodiments.

FIG. 3 is a simplified schematic cross-section of an electrolysis cell diode 300 (e.g., an MOE system), according to some embodiments. Various elements are not illustrated for sake of clarity. System 300 includes a vessel 302, a liquid cathode 304, a cell anode 306, a diode cathode 308, and a diode anode 310. Liquid cathode 304 and cell anode 306 form, in part, an electrolysis cell 312. Diode cathode 308 and diode anode 310 form, in part, a thermionic diode 314. Accordingly, cell anode 306 and diode cathode 308 are the same element, as explained below. Electrical terminals 316 and 318 may be connected to a step-down transformer or other cell diodes, for example.

Figure 4:
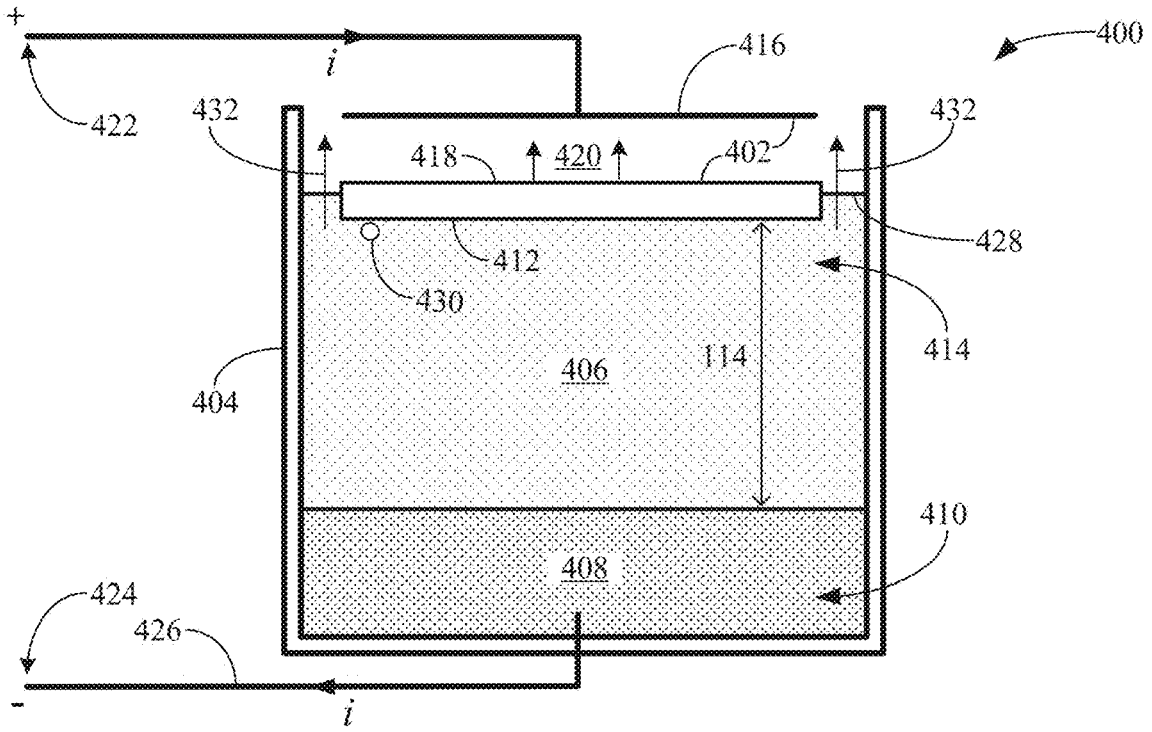
FIG. 4 is a schematic cross-section of a molten oxide electrolysis system including a thermionic diode, according to some embodiments.

FIG. 4 is a schematic cross-section of an MOE system 400 that includes a thermionic diode 402, according to some embodiments. Various portions of the system, as illustrated, are not necessarily to scale. MOE system 400 generally comprises electrical and mechanical components that are interfaced with one another in various configurations. For example, though not illustrated, the various electrodes may be physically supported by structural members that may be at least partially electrically conductive and at least partially made of a refractory material. The MOE system may further comprise one or more computer processors (not illustrated) configured to execute computer-readable instructions, which may be directed to controlling at least some of the electrical and mechanical components, such as controlling relative positioning of anodes and cathodes of the system, for example.

MOE system 400, which may be the same as or similar to electrolysis cell diode 300, may include a vessel 404 configured to contain a melted oxide material 406 that includes a liquid cathode 408 (e.g., 304) at a bottom portion 410 of the vessel. A cell anode 412 (e.g., 306) may be in a top portion 414 of the vessel. Vessel 404 may be made of a refractory material that can withstand relatively high temperatures and still retain structural stability and strength. Cell anode 412 may be made of a refractory material that is conductive and can withstand relatively high temperatures and still retain structural stability and strength.

Liquid cathode 408, cell anode 412, and melted oxide material 406 are herein referred to as an MOE cell to be distinguished from thermionic diode 402. Cell anode 412 may be positioned to be partially submerged in melted oxide material 406 and in electrical communication with liquid cathode 408 via the melted oxide material during an MOE process. Thermionic diode 402 comprises a diode anode 416 and a diode cathode 418, which may be made of refractory materials that are conductive and can withstand relatively high temperatures and still retain structural stability and strength.

As is the case for electrolysis cell diode 300, diode cathode 418 is the same electrode as cell anode 412. In other words, a top portion of cell anode 412 may function in an MOE process as diode cathode 418 of thermionic diode 402. For example, during the MOE process, diode cathode 418 (e.g., cell anode 412) may be heated by melted oxide material 406 so as to thermionically emit electrons. These emitted electrons may flow, as indicated by arrows 420, to diode anode 416. For at least the reason that the temperature of diode cathode 418 (cell anode 412) is substantially higher than the temperature of diode anode 416, electron flow during a thermionic process is unidirectional from the cathode to the anode of thermionic diode 402. In other words, the thermionic process prevents electron flow from diode anode 416 to diode cathode 418. Conventionally, electrical current, i, is defined as being opposite the flow of electrons. Accordingly, during a during a thermionic process, which may occur during an MOE process in MOE system 400, electrical current i flows from positive electrode 422 to negative electrode 424 via thermionic diode 402 and the MOE cell of system 400. For example, current i may enter system 400 via diode anode 416 and exit system 400 via a cathodic electrode 426 that is in electrical contact with liquid cathode 408.

As mentioned above, during an MOE process, cell anode 412 may be partially submerged in melted oxide material 406 so that the anode can be in electrical communication with liquid cathode 408 via the melted oxide material. Being partially submerged, a top portion of cell anode 412 is above a top surface 428 of melted oxide material so that electrons emitted from the top portion of cell anode (e.g., diode cathode 418) can flow to diode anode 416 unobstructed by the melted oxide material.

During the MOE process, oxygen ions (e.g., $O^{2-}$) flow toward cell anode 412 and are oxidized to produce oxygen gas (02) 430, which may be in the form of bubbles. The oxygen gas can interfere with emitted electron flow 420. Accordingly, in some implementations, flows 432 of electrolytically produced oxygen gas may be at least partially controlled or modified to reduce or minimize the amount of oxygen gas present between cell anode 412 (e.g., diode cathode 418) and diode anode 416. In some implementations, flow of oxygen gas 430 may be guided into an enclosed volume (not illustrated) above top surface 428 of the molten oxide material. The oxygen gas may then be collected from system 400 for storage and later use, for example.

The electrical current for an electrolysis process of system 400 may maintain the molten state of molten oxide material 406 during the electrolysis process. In some implementations, a method for initially heating and melting the oxide material may use Joule heating by an electrical current that may be different from that of the electrolysis process. In some implementations, induction heating or electrical Joule heating from conductors outside the oxide material may be used for initially melting the oxide material. In some cases, the oxide material may be molten before being placed in the electrolysis vessel. Claimed subject matter is not limited in this respect.

Figure 5:
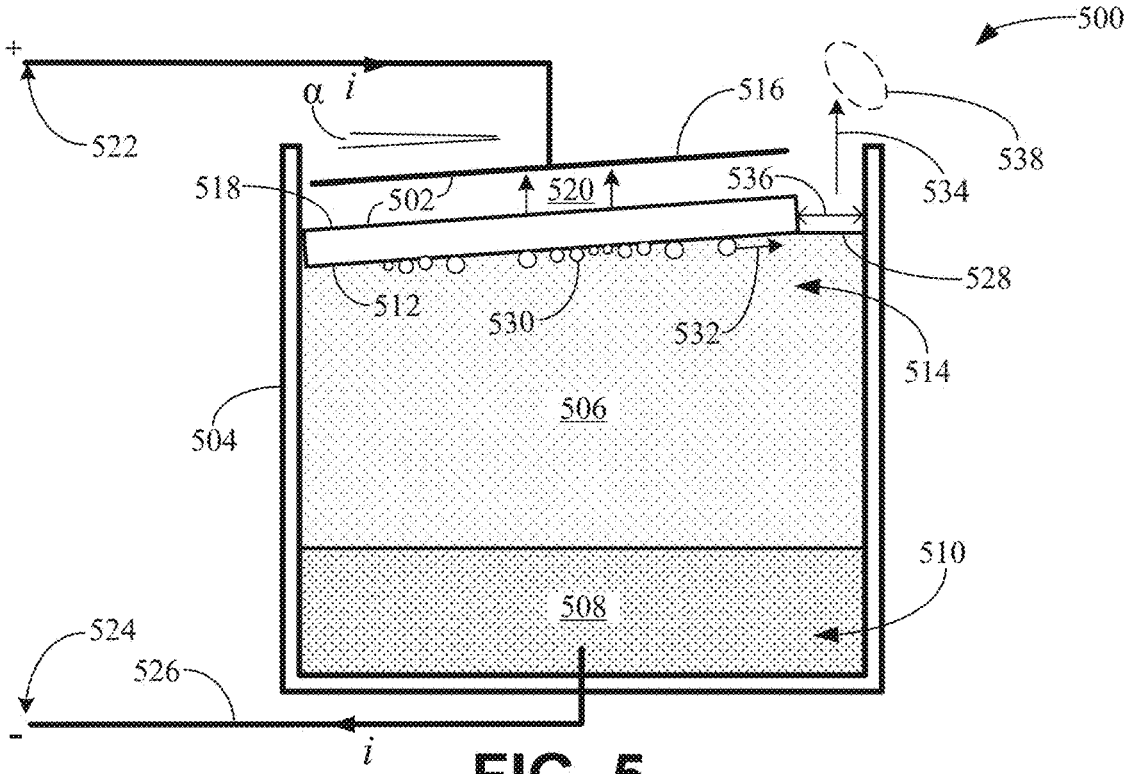
FIG. 5 is a schematic cross-section of a molten oxide electrolysis system including a thermionic diode and a structure that at least partially guides oxygen flow, according to some embodiments.

FIG. 5 is a schematic cross-section of an MOE system 500 that includes a thermionic diode 502 and, as described below, a structure that at least partially guides oxygen gas flow, according to some embodiments. In some respects, MOE system 500 may be the same as or similar to MOE system 400 and may include a vessel 504 configured to contain a melted oxide material 506 that includes a liquid cathode 508 (e.g., 304) at a bottom portion 510 of the vessel. A cell anode 512 (e.g., 306) may be in a top portion 514 of the vessel.

Liquid cathode 508, cell anode 512, and melted oxide material 506 form an MOE cell, which is to be distinguished from thermionic diode 502. Cell anode 512 may be positioned to be partially submerged in melted oxide material 506 and in electrical communication with liquid cathode 508 via the melted oxide material during an MOE process. Thermionic diode 502 comprises a diode anode 516 and a diode cathode 518, both of which may be made of refractory materials that are conductive and can withstand relatively high temperatures and still retain structural stability and strength.

As is the case for electrolysis cell diode 300, diode cathode 518 is the same electrode as cell anode 512. In other words, a top portion of cell anode 512 may function in an MOE process as diode cathode 518 of thermionic diode 502. For example, during the MOE process, diode cathode 518 (e.g., cell anode 512) may be heated by melted oxide material 506 so as to thermionically emit electrons. These emitted electrons may flow, as indicated by arrows 520, to diode anode 516. As explained above, for at least the reason that the temperature of diode cathode 518 (cell anode 512) is substantially higher than the temperature of diode anode 516, electron flow during a thermionic process is unidirectional from the cathode to the anode of thermionic diode 502. In other words, the thermionic process prevents electron flow from diode anode 516 to diode cathode 518. Accordingly, during a during a thermionic process, which may occur during an MOE process in MOE system 500, electrical current i flows from positive electrode 522 to negative electrode 524 via thermionic diode 502 and the MOE cell of system 500. For example, current i may enter system 500 via diode anode 516 and exit system 500 via a cathodic electrode 526 that is in electrical contact with liquid cathode 508.

As mentioned above, during an MOE process, cell anode 512 may be partially submerged in melted oxide material 506 so that the anode can be in electrical communication with liquid cathode 508 via the melted oxide material. Being partially submerged, a top portion of cell anode 512 is above a top surface 528 of the melted oxide material so that electrons emitted from the top portion of cell anode (e.g., diode cathode 518) can flow to diode anode 516 unobstructed by the melted oxide material.

During the MOE process, oxygen ions flow toward cell anode 512 and are oxidized to produce oxygen gas 530, which may be in the form of bubbles. The oxygen gas can interfere with emitted electron flow 520. Accordingly, in some implementations, cell anode 512 (e.g., diode cathode 518) may be angled substantially away from horizontal, such as by an angle $\alpha$, so that oxygen gas produced by the MOE process flows mostly toward one side of the vessel, as indicated by arrows 532 and 534. Such a flow may reduce the amount of oxygen gas that drifts between the diode cathode (e.g., the cell anode) and the diode anode. For example, arrow 532 indicates a buoyancy flow of oxygen bubbles on the underside of cell anode 512 toward an opening 536 between an edge of the cell anode and vessel 504. System 500 may be configured so that opening 536 is relatively close to an area of oxygen collection 538 where oxygen is removed from system 500, such as for later use, for example. Such a configuration may help prevent oxygen from flowing between the thermionic diode electrodes (e.g., 516 and 518).

Figure 6:
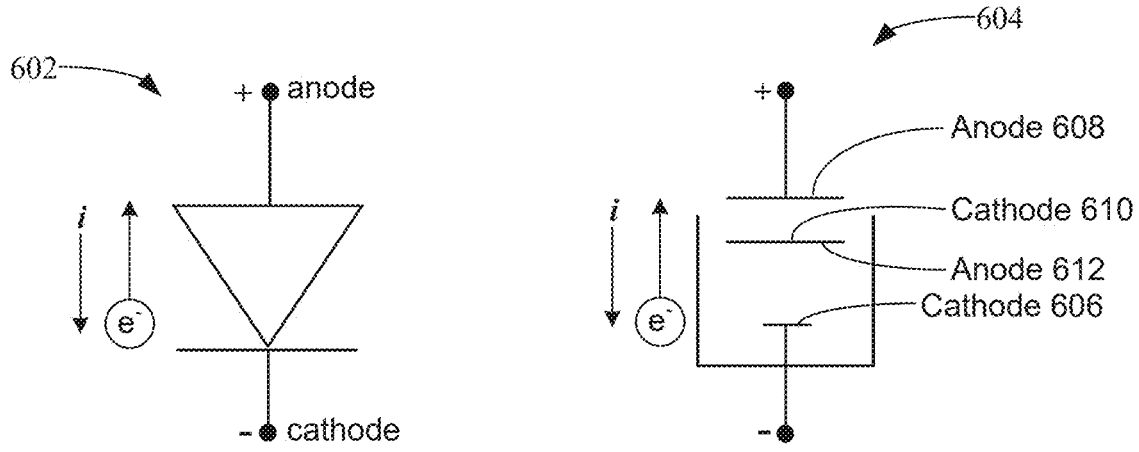
FIG. 6 illustrates a diode symbol and an electrolysis cell diode symbol, both annotated to show electron and current flow directions, according to some embodiments.

FIG. 6 illustrates a diode symbol 602 and an electrolysis cell diode symbol 604, both annotated to show electron and current flow directions, according to some embodiments. Electrolysis cell diode symbol 604 is also annotated with labels identifying the various anodes and cathodes of the electrolysis cell portion and the thermionic diode portion of an MOE system, such as 400 and 500, for example. Symbols 602 and 604 are used in some of the following figures and descriptions thereof.

As mentioned above, conventionally, electrical current, i, is defined as being opposite the flow of electrons e". Beginning with diode symbol 602, electrons flow from the cathode to the anode of the diode and current i flows in the opposite direction. Analogously, electrons flow from cathode 606 to the anode 608 of electrolysis cell diode (e.g., represented by symbol 604) and current i flows in the opposite direction. Therebetween, electrons flow from cathode 610, which is the same electrode as a cell anode 612, to anode 608 of the thermionic diode portion of the electrolysis cell diode and current i flows in the opposite direction. Accordingly, during a thermionic process, which may occur during an MOE process in MOE system 400 or 500, for example, electrical current i flows from the positive electrode to the negative electrode.

Figure 7:
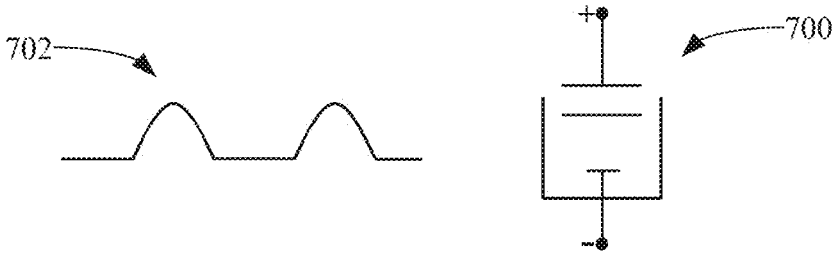
FIG. 7 is a schematic diagram of a molten oxide electrolysis system and a waveform of the electrical power transmitting therethrough, according to some embodiments.

FIG. 7 is a schematic diagram of an MOE system 700 and a waveform 702 of the electrical power transmitting therethrough during an MOE process, according to some embodiments. System 700 may receive, for example, a sinusoidal AC input at the positive and negative terminals illustrated. System 700, which includes a thermionic diode, such as 402 or 502, may only allow current to flow from the positive terminal to the negative terminal. This unidirectional current flow may lead to the half-wave rectified waveform 702 that represents the power flow as a function of time through MOE system 700. This unidirectional flow is preferred over bidirectional flow for the electrolysis process of system 700. Accordingly, MOE system 700 may be the same as or similar to material processing 202 wherein a rectifier (e.g., 110) is not needed at the system's input due to system 700 having the ability to rectify an AC signal on its own.

Figure 8:
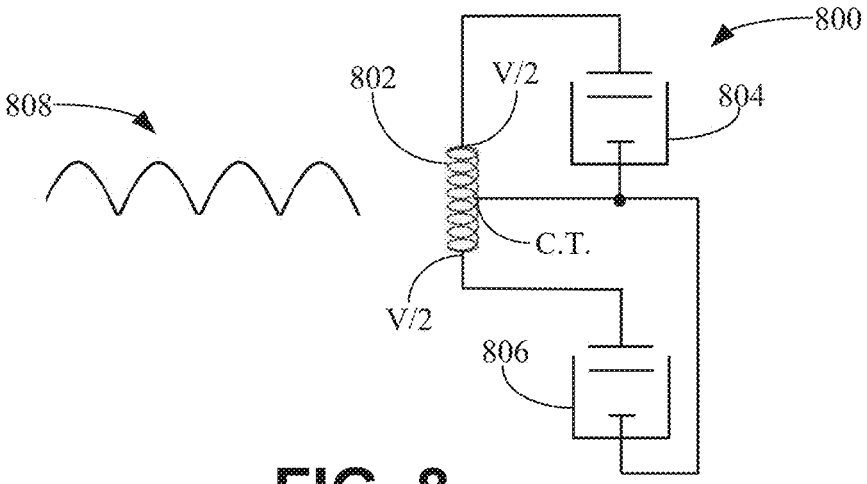
FIG. 8 is a schematic diagram of a molten oxide electrolysis system powered by a center-tapped stepdown transformer, according to some embodiments.

FIG. 8 is a schematic diagram of an MOE system 800 powered by a center-tapped stepdown transformer 802, according to some embodiments. Transformer 802 may be the same as or similar to step-down transformer 208, for example. MOE system 800 may include a first electrolysis cell diode 804 that is connected to an upper half of the center-tapped transformer and a second electrolysis cell diode 806 that is connected to a lower half of the center-tapped transformer. Thus, each of the first and the second electrolysis cell diodes 804 and 806 are connected across V/2, where V is the full output voltage of transformer 802. The voltage across first electrolysis cell diode 804, however, is 180 degrees out of phase from the voltage across second electrolysis cell diode 806. Each electrolysis cell diode 804 and 806 may be powered by a half-wave rectified waveform such as 702. But together, system 800 is powered by a full-wave rectified signal 808, for example. Thus, system 800 may have an efficiency that is double that of system 700 because system 800 utilizes the power input during all phases of the AC input signal, wherein system 700 uses half.

Figure 9:
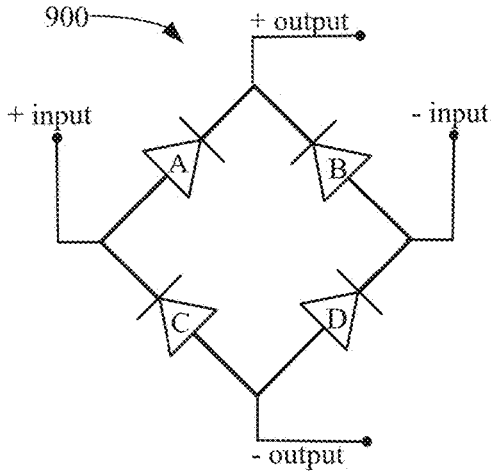
FIG. 9 is a schematic diagram of a diode bridge rectifier, according to some embodiments.

FIG. 9 is a schematic diagram of a diode bridge rectifier 900, according to some embodiments. Generally, a diode bridge is a bridge rectifier circuit that includes four diodes and is used in the process of converting alternating current from the input terminals to direct current on the output terminals. It may convert the negative voltage portions of the AC waveform to positive voltage. The bridge rectifier may provide full-wave rectification from a two-wire AC input, similar to the function of a center-tapped transformer (e.g., 802). Each diode is labelled in FIG. 9 for sake of clarity in some of the descriptions below.

Figure 10:
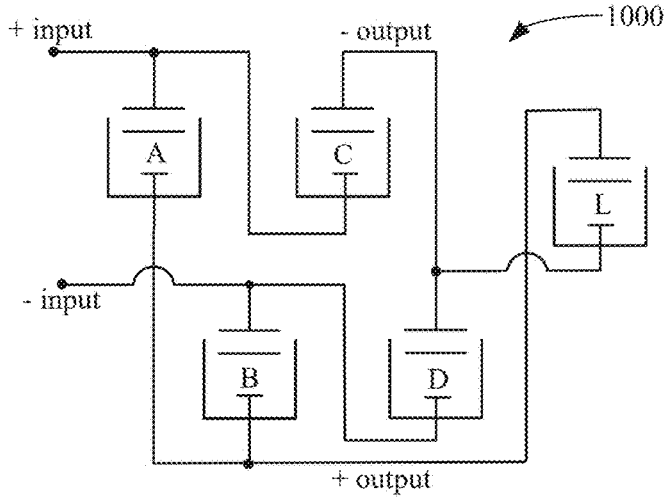
FIG. 10 is a schematic diagram of a molten oxide electrolysis system that includes electrolysis cell diodes in a diode bridge rectifier configuration, according to some embodiments.

FIG. 10 is a schematic diagram of an MOE system 1000 that includes electrolysis cell diodes in a diode bridge rectifier configuration, according to some embodiments. Accordingly, the electrolysis cell diodes in system 1000 are arranged functionally the same as the electrolysis cell diodes of bridge rectifier 900. The labels A, B, C, and D in each of the electrolysis cell diodes identify their connections relative to one another. The functional similarity between bridge rectifier 900 and MOE system 1000 is due to electrolysis cell diodes operating like diodes, as described for FIG. 6. As explained above, the output of a bridge rectifier, such as 900, is a full-wave rectified signal. Similarly, the output of electrolysis cell diodes A, B, C, and D is also a full-wave rectified signal, which may be provided as an input to an electrolysis cell diode load L. Thus system 1000 may operate with relatively high efficiency, utilizing all phases of AC power, which system 1000 rectifies to DC.

Figure 11:
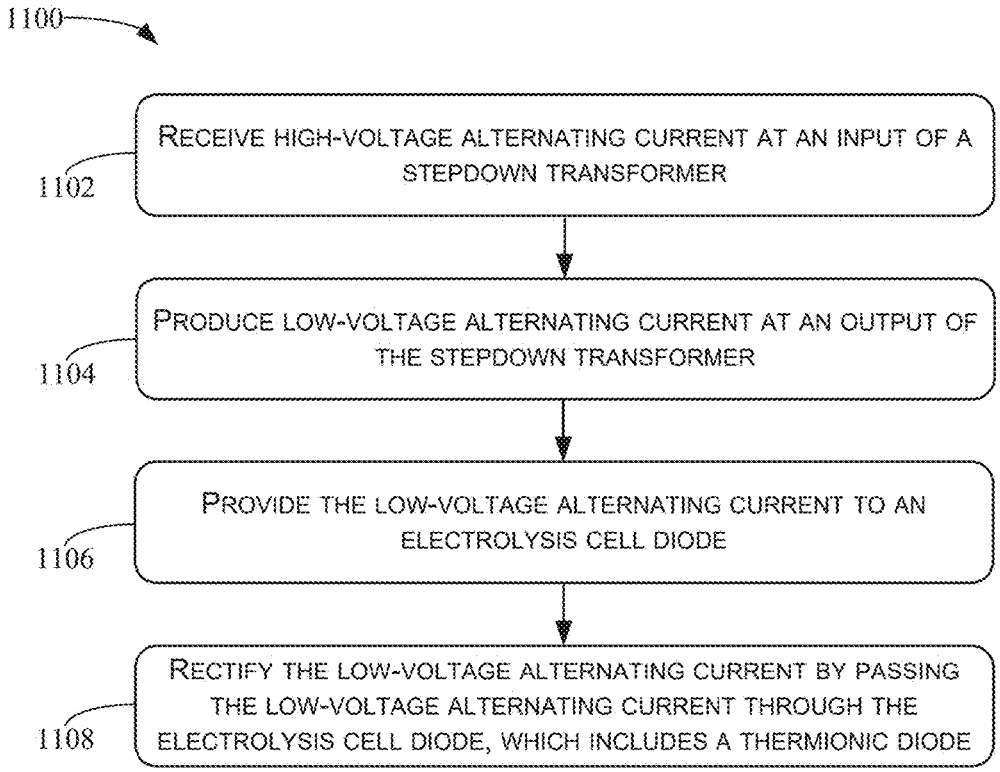
FIG. 11 is a flow diagram of a process of operating a molten oxide electrolysis system, according to some embodiments.

FIG. 11 is a flow diagram of a process 1100 of operating an MOE system, according to some embodiments. The process may be performed by an operator, which may be a person or persons, a computer processor executing computer-readable code, or a combination thereof. Process 1100 may be performed by the operator using MOE system 400 or 500, for example. Moreover, each such system may be configured the same as or similarly to MOE system 700, 800, or 900, for example.

By using an electrical current, the operator may produce electrolysis in a vessel containing a melted oxide material that includes a liquid cathode at a bottom portion of the vessel and an anode in a top portion of the vessel, as described above for the various illustrated embodiments. At 1102, the operator may arrange to have a stepdown transformer (e.g., 208) receive (e.g., from electrical conductor(s) 212) high-voltage alternating current at its input. Accordingly, at 1104, the stepdown transformer may produce low-voltage alternating current at its output, such as on conductor(s) 214. At 1106, the operator may arrange an electrolysis cell diode of the MOE system to receive the low-voltage alternating current. At 1108, the operator may rectify the low-voltage alternating current by passing the low-voltage alternating current through the electrolysis cell diode, which includes a thermionic diode.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments or examples are presented by way of examples for purposes of illustration and description. They are not intended to be exhaustive of or to limit this disclosure to the precise forms described. Many modifications and variations are possible in view of the above teachings. The embodiments or examples are shown and described in order to best explain the principles of this disclosure and practical applications, to thereby enable others skilled in the art to best utilize this disclosure and various embodiments or examples with various modifications as are suited to the particular use contemplated. It is intended that the scope of this disclosure be defined by the following claims and their equivalents.

We claim as follows:

1. A molten oxide electrolysis (MOE) system comprising:

a vessel configured to contain a melted oxide material that includes a liquid cathode at a bottom portion of the vessel;

a cell anode in a top portion of the vessel and, during an MOE process, configured to be partially submerged in the melted oxide material and in electrical communication with the liquid cathode via the melted oxide material; and a thermionic diode in the top portion of the vessel and including a diode anode and a diode cathode.

2. The MOE system of claim 1, wherein a top portion of the cell anode is the diode cathode and the diode anode is above and facing the diode cathode.

3. The MOE system of claim 2, wherein a vacuum gap is defined between the diode cathode and the diode anode.

4. The MOE system of claim 1, wherein the diode cathode is configured to be heated to thermionically emit electrons by the melted oxide material.

5. The MOE system of claim 1, wherein the thermionic diode is configured to be exposed to the vacuum of the lunar surface during the MOE process.

6. The MOE system of claim 1, wherein the cell anode is angled substantially away from horizontal.

7. The MOE system of claim 6, wherein the cell anode is angled substantially away from horizontal so that oxygen gas produced at the cell anode flows toward a side of the vessel and away from a space between the diode anode and the diode cathode.

8. The MOE system of claim 1, further comprising a structure positioned adjacent the cell anode and configured to direct oxygen gas produced at the cell anode toward a collection region located away from a space between the diode anode and the diode cathode.

9. The MOE system of claim 1, wherein the diode anode and the diode cathode each comprise a refractory material that is electrically conductive and capable of withstanding temperatures of at least 1400° C.

10. The MOE system of claim 1, further comprising one or more computer processors configured to control positioning of the cell anode relative to the liquid cathode.

11. A molten oxide electrolysis (MOE) system comprising:

a stepdown transformer; and an electrolysis cell diode connected to an output of the stepdown transformer, wherein the electrolysis cell diode includes a vessel configured to contain a melted oxide material that includes a liquid cathode at a bottom portion of the vessel, a cell anode in a top portion of the vessel and, during an MOE process, configured to be partially submerged in the melted oxide material and in electrical communication with the liquid cathode via the melted oxide material, and a thermionic diode in the top portion of the vessel and including a diode anode and a diode cathode.

12. The MOE system of claim 11, wherein the diode cathode is configured to be heated to thermionically emit electrons by the melted oxide material.

13. The MOE system of claim 11, wherein a top portion of the cell anode is the diode cathode and the diode anode is above the diode cathode and facing the diode cathode to receive electrons that are thermionically ejected from the top portion of the cell anode.

14. The MOE system of claim 11, wherein the electrolysis cell diode is a first electrolysis cell diode, the system further comprising a second electrolysis cell diode.

15. The MOE system of claim 14, wherein the stepdown transformer is a center-tapped transformer, the first electrolysis cell diode is connected to an upper half of the center-tapped transformer to produce a first half-wave rectified voltage, and the second electrolysis cell diode is connected to a lower half of the center-tapped transformer to produce a second half-wave rectified voltage, wherein the first half-wave rectified voltage is 180 degrees out of phase from the second half-wave rectified voltage.

16. The MOE system of claim 11, wherein the electrolysis cell diode is a first electrolysis cell diode, the system further comprising additional electrolysis cell diodes that are electrically connected to the first electrolysis cell diode and to one another.

17. The MOE system of claim 16, wherein the additional electrolysis cell diodes are electrically connected to the first electrolysis cell diode and to one another in a bridge rectifier configuration.

18. The MOE system of claim 17, further comprising an electrolysis cell diode load connected to output terminals of the bridge rectifier configuration so that the electrolysis cell diode load is configured to receive a full-wave rectified voltage.

19. The MOE system of claim 11, wherein the thermionic diode is exposed to the vacuum of the lunar surface.

20. The MOE system of claim 11, wherein the oxide material is lunar regolith.

* * * * *